US006220965B1

(12) United States Patent
Hanna et al.

(10) Patent No.: US 6,220,965 B1
(45) Date of Patent: Apr. 24, 2001

(54) AMUSEMENT SYSTEM

(75) Inventors: Craig R. Hanna; Jennifer K. Sauer; Philip D. Hettema, all of Universal City, CA (US)

(73) Assignee: Universal City Studios Inc., Universal City, CA (US)

( * ) Notice: Subject to any disclaimer, the term of this patent is extended or adjusted under 35 U.S.C. 154(b) by 0 days.

(21) Appl. No.: 09/111,954

(22) Filed: Jul. 8, 1998

(51) Int. Cl.[7] ..... A63B 67/00

(52) U.S. Cl. ..... 463/52; 463/53; 472/18

(58) Field of Search ..... 463/5, 30, 34, 463/52–53, 50–51; 434/20, 21, 22; 472/29, 30, 43, 57–60, 1, 14, 16, 18, 44, 61–62, 28, 35; 273/434; 297/344.23

(56) References Cited

U.S. PATENT DOCUMENTS

| | | | | |
|---|---|---|---|---|
| 4,054,290 | | 10/1977 | Villa . | |
| 4,533,144 | * | 8/1985 | Juarez et al. | 463/50 |
| 4,830,381 | | 5/1989 | Sellner . | |
| 4,846,529 | | 7/1989 | Tulley . | |
| 4,976,438 | | 12/1990 | Tashiro et al. . | |
| 5,127,657 | | 7/1992 | Ikezawa et al. . | |
| 5,320,362 | | 6/1994 | Bear et al. . | |
| 5,382,026 | | 1/1995 | Harvard et al. . | |
| 5,403,238 | | 4/1995 | Baxter et al. . | |
| 5,453,053 | | 9/1995 | Danta et al. . | |
| 5,527,221 | * | 6/1996 | Brown et al. | 472/43 |
| 5,613,913 | | 3/1997 | Ikematsu et al. . | |
| 5,623,878 | | 4/1997 | Baxter et al. . | |
| 5,662,523 | | 9/1997 | Yasumaru et al. . | |
| 5,716,281 | * | 2/1998 | Dote | 463/2 |
| 5,785,592 | * | 7/1998 | Jacobson | 463/52 |
| 5,906,542 | * | 5/1999 | Neumann | 463/52 |

* cited by examiner

*Primary Examiner*—Mark Sager
(74) *Attorney, Agent, or Firm*—Lyon & Lyon LLP

(57) ABSTRACT

An amusement system has first and second paths extending through an amusement attraction. Vehicles moving along the paths have simulated weapons. Riders in the vehicles shoot at targets along the paths or on the vehicles. If sufficient points are accumulated, by hitting targets, or other events occur, the riders in the first vehicle can cause the movement of the second vehicle to change, for example, causing the second vehicle to spin, or to slow down.

17 Claims, 4 Drawing Sheets

AMUSEMENT SYSTEM

The field of the invention is amusement ride attractions and systems.

Amusement rides have long been well liked by both children and adults, due to the excitement and thrills created in part by the movement of a ride vehicle through an attraction. Arcade style shooting games have also been a popular game of skill for many years.

Amusement rides and shooting games have been combined into amusement systems. In these systems, passengers sit in a vehicle which moves through a ride attraction. The passengers are provided with simulated weapons, for shooting at various targets within the attraction. The simulated weapons typically project a light beam. When photo sensors in the targets detect the light beam, the target has been "hit" and the player accumulates points.

While these types of amusement ride/shooting games have been successfully used, it has now been discovered that they lack certain design elements which significantly improve the rider's experience. In addition, with the ever increasing sophistication of entertainment provided by home video games, arcade games, motion pictures, and amusement park rides and attractions, there is a need for an improved amusement ride/shooting game system offering greater excitement, thrills, and levels of competition.

SUMMARY OF THE INVENTION

It is therefore an object of the invention to provide a new amusement system combining features from a ride attraction, and from a shooting game, together with new features, to provide a more exciting and/or challenging experience for riders.

To this end, in a first aspect of the invention, an amusement system includes first and second vehicles moveable along first and second paths. The first and second vehicles, at least initially, advance through the ride attraction adjacent to each other. Consequently, passengers in the first and second vehicles can shoot at targets in competition with each other.

In a second separate aspect of the invention, a vehicles moves on a path through an attraction. Passengers are accommodated in passenger positions on a vehicle body. The vehicle body is rotatably supported on a vehicle chassis. The body spins relative to the moving or stationary chassis, depending on events occurring during the ride.

In a third aspect of the invention, movement of a first or second vehicle along a path is changed depending upon events occurring during the ride. As an example, the "second" vehicle spins around, or slows down, if the points accumulated by passengers in the "first" vehicle exceed a predetermined limit, or if passengers in the first vehicle shoot and hit a vehicle target on the second vehicle.

Other objects and features of the invention will become apparent from the following detailed description taken in connection with the accompanying drawings. The drawings, however, are provided only for the purpose of illustration of the preferred embodiment, and should not be taken as a limitation of the invention.

BRIEF DESCRIPTION OF THE DRAWINGS

In the drawings, wherein the same element number denotes the same element, throughout the several views.

DETAILED DESCRIPTION OF THE DRAWINGS

Figure 1:
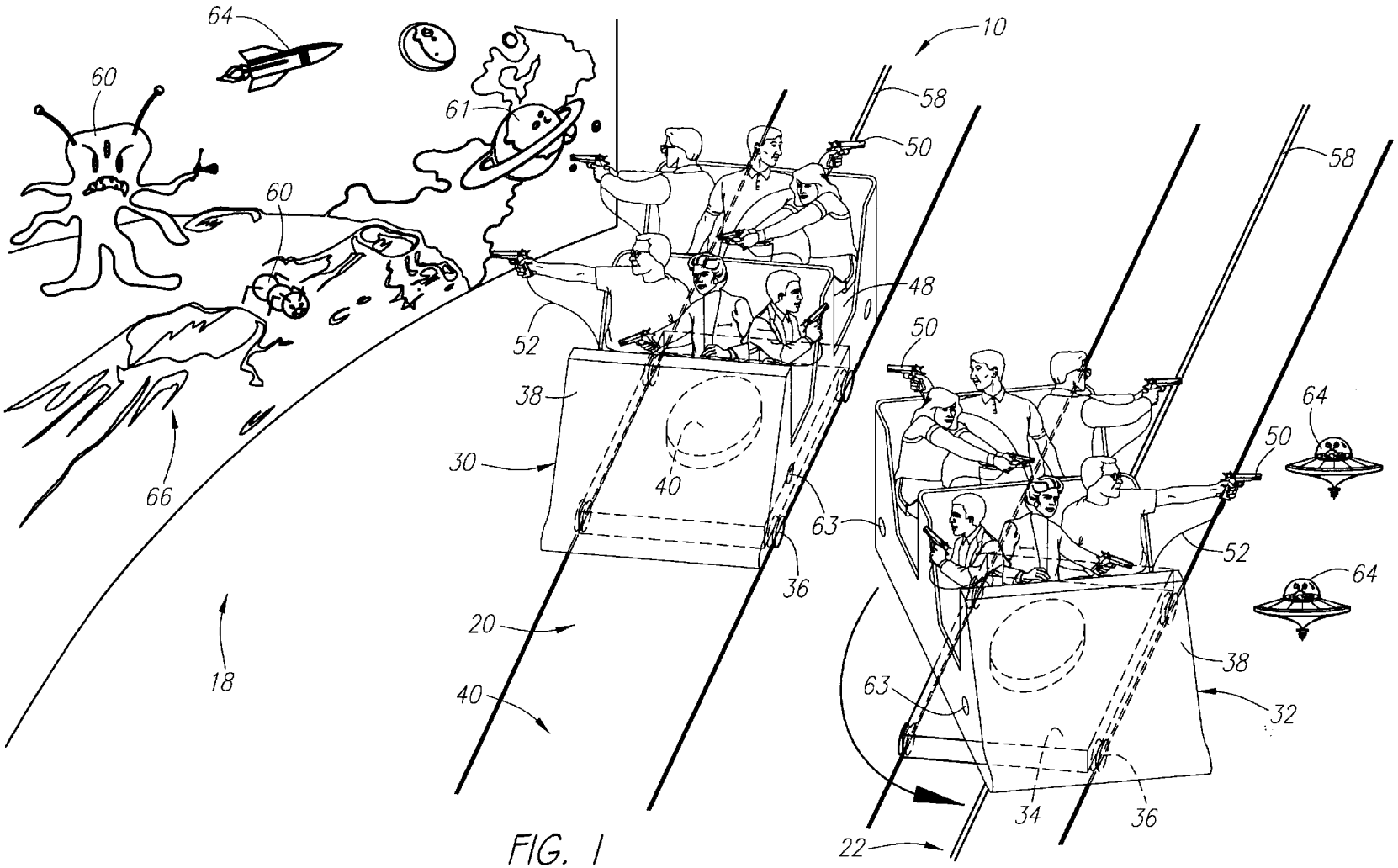
FIG. 1 is a perspective view of a game room or scene of the present amusement system.
Figure 2:
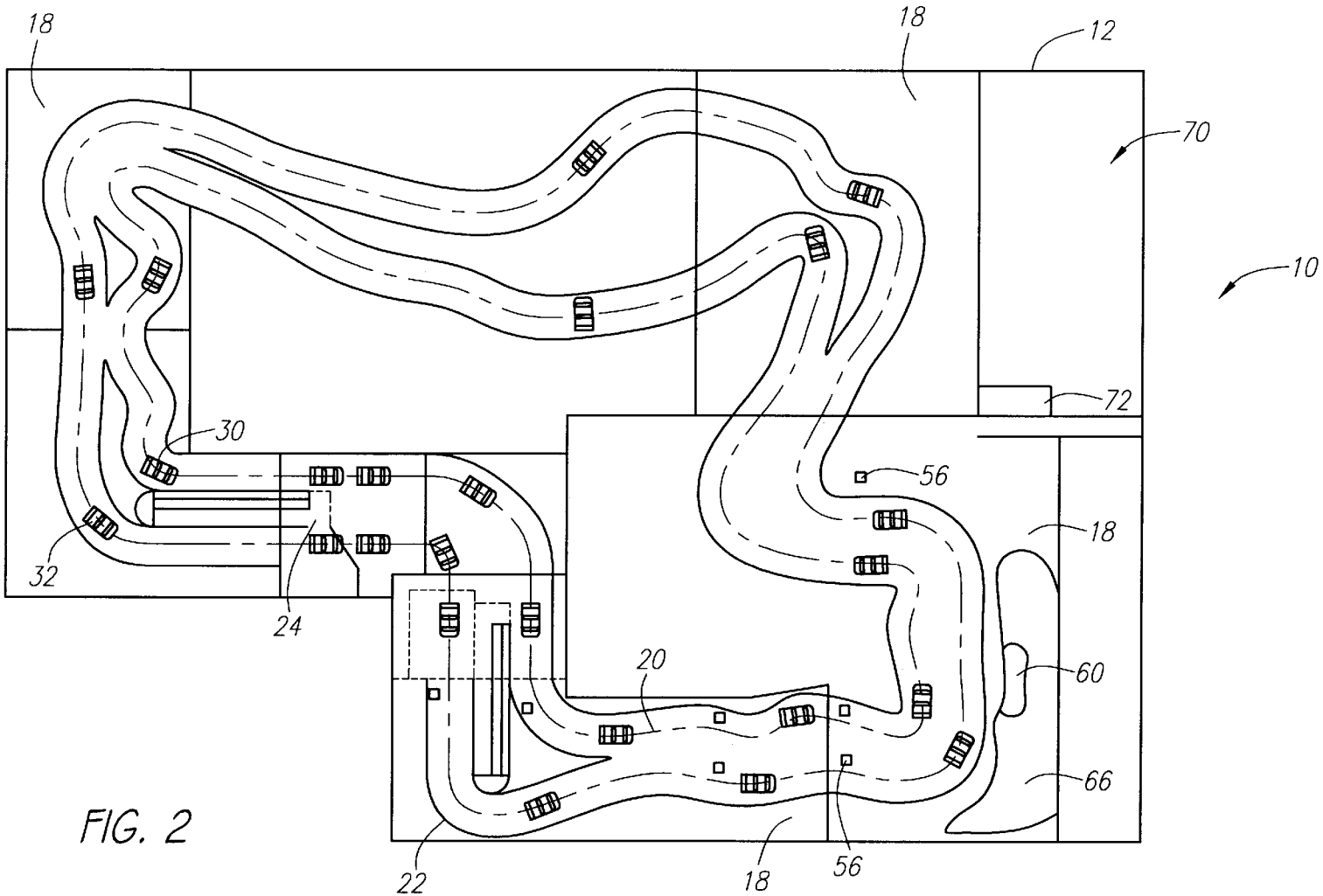
FIG. 2 is a schematic plan view of the entire amusement system.

Referring now in detail to the drawings, as shown in FIGS. 1 and 2, the present amusement system 10 has multiple game rooms or scenes 18 within a building 12. A first path 20 and a second path 22 extend generally side by side through the various game rooms 18, in a continuous loop. A passenger loading/unloading platform 24 is provided on either side or in-between the first path 20 and second path 22 within the building 12.

A first vehicle 30 moves along the first path 20, and a second vehicle 32 moves along the second path 22. The vehicles 30 and 32 have wheels 36, either above or below the track floor or ground 35 of the game rooms 18. The first path 20 and second path 22 preferably include tracks or rails on which the wheels 36 roll, to guide the vehicles through the game rooms. A buss bar 58 or equivalent electrical power transfer device advantageously runs under or in each path 20 and 22, to provide power and optionally data communications to the vehicles 30 and 32.

Figure 3:
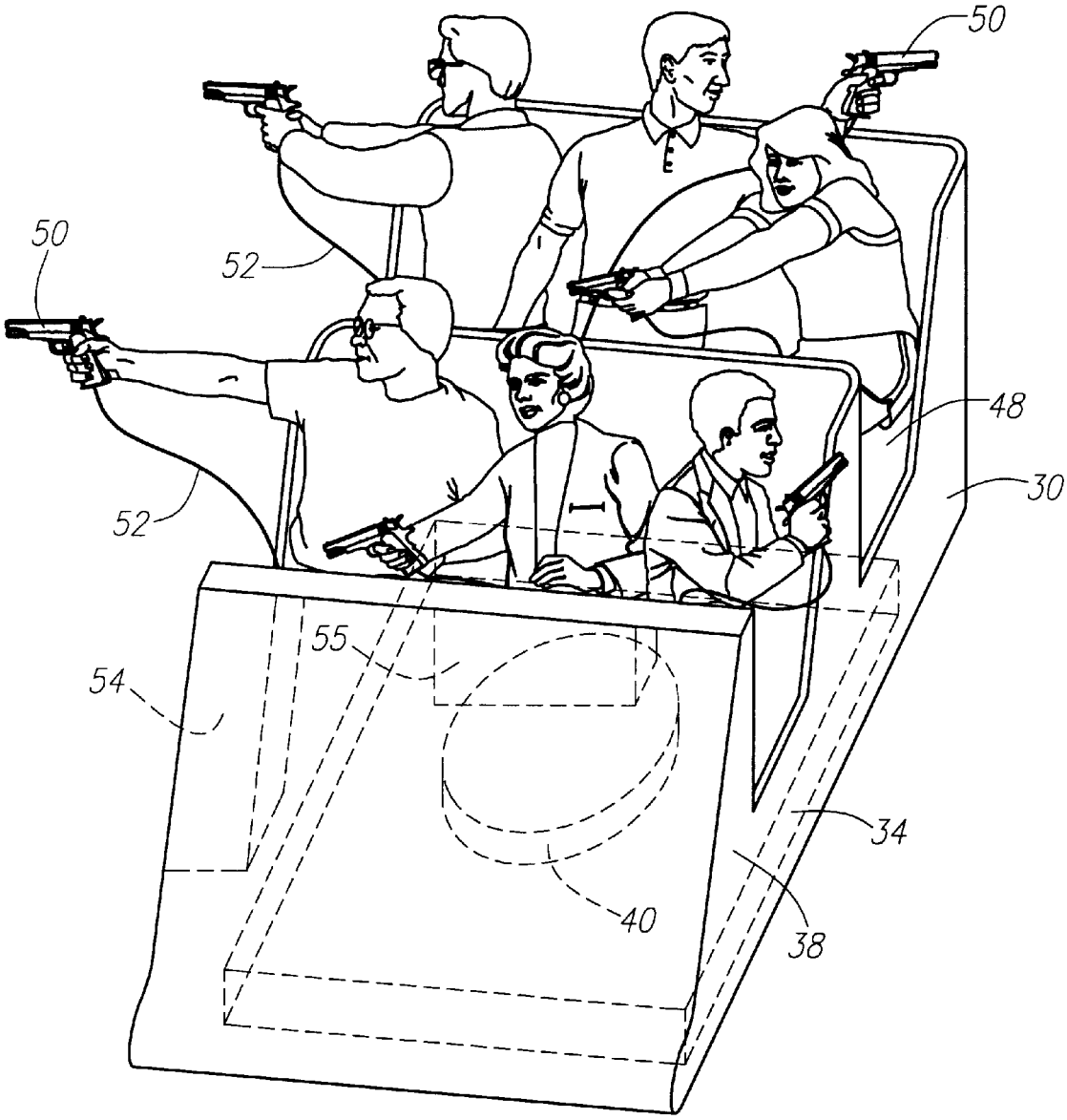
FIG. 3 is an enlarged view of one of the vehicles shown in FIG. 1.
Figure 4:
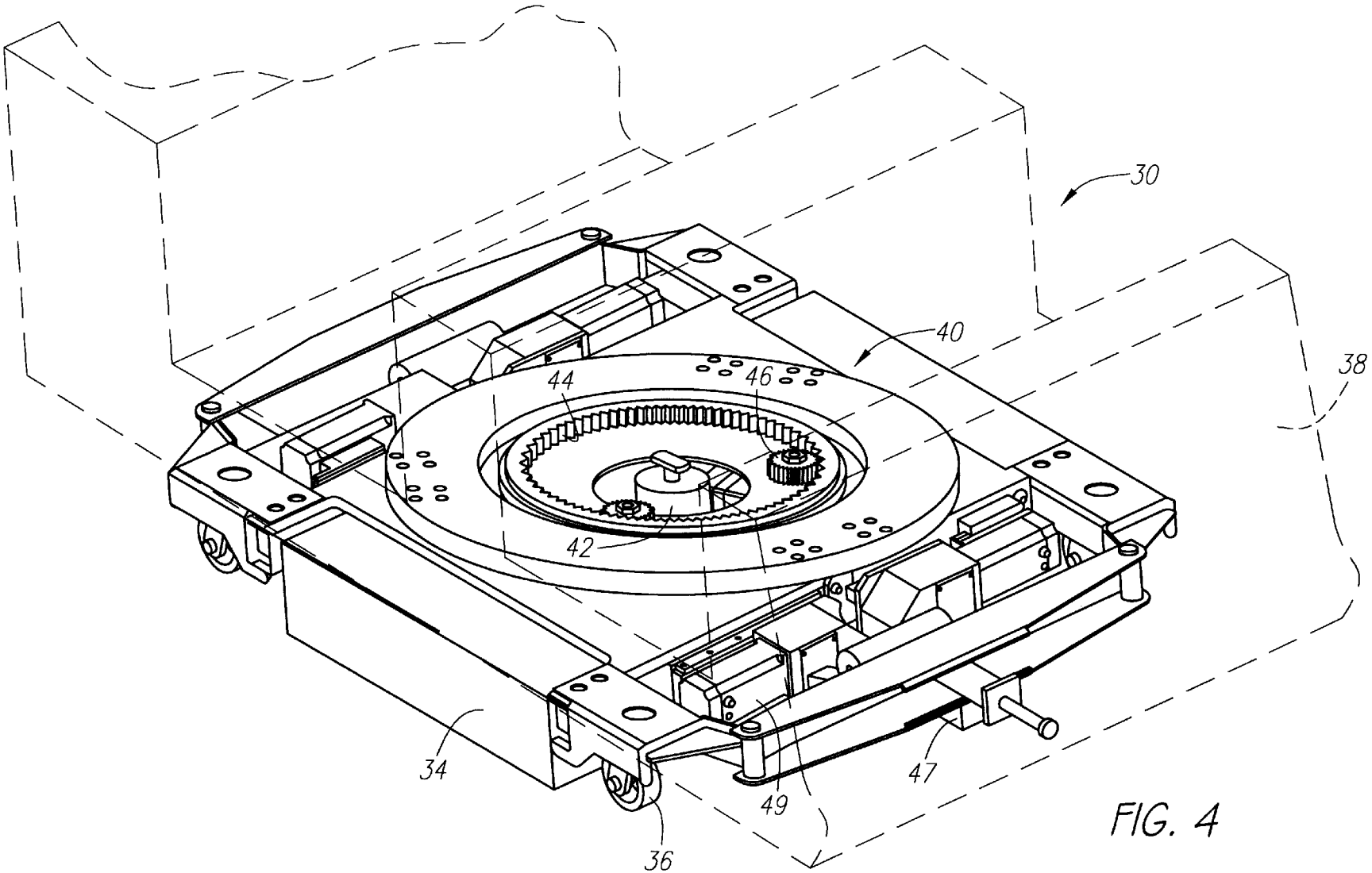
FIG. 4 is a perspective view showing various elements of the vehicles shown in FIGS. 1 and 3.

Turning now to FIGS. 3 and 4, the first vehicle 30 has a body 38 having rider positions, or seats 48, for accommodating riders. The vehicle body 38 is supported on a turntable 40, which in turn is supported on a vehicle chassis 34. The chassis 34 rolls along the path 20 on the wheels 36. Various turning or spinning attachments between the body 38 and chassis 34 may be used in place of the turntable 40. In the embodiment shown, the turntable 40 includes a ring gear 44 attached to the body 38. A vehicle spin motor 42 turns a pinion gear 46 meshed with the ring gear 44, so that the vehicle body 38 spins on the chassis 34 when the spin motor 42 is turned on. Drive motors 49 power the wheels 36 to propel the vehicle along the path. Alternatively, the vehicles can be moved along the path by other well-known techniques. The second vehicle 32 is preferably identical in engineering design to the first vehicle 30, although it may have different schematic scenic external appearances and/or props.

Referring to FIG. 3, simulated weapons 50 are provided on the vehicle body 38 at each passenger position 48. Each weapon 50 is connected to the vehicle body 38, and to a vehicle computer 54 on the vehicle, via a cable or via a wireless link 52. When a passengers pulls the trigger of the weapon 50, the weapon emits a directed or collimated beam of light. Lights on the weapon 50 may also light up, and sounds may be emitted from the weapon, when the trigger is pulled to provide information or feedback to the rider, or to better simulate the theme of the amusement system. Preferably, each vehicle is provided with different type of weapons, having different shooting or scoring characteristics, to offer a greater variety of experiences for the riders. Vehicle displays 55 are provided on the vehicle body 38, to display various information to the riders.

Referring to FIG. 1, animated FIGS. 60 are provided along the paths 20 and 22, along with various fixed targets 61, moving targets 64, and scenery 66. The animated FIGS. 60 and targets 61 and 64 have detectors 62, which detect when they are "hit" by a light beam emitted from a weapon 50. Vehicle targets 63 may also be placed on the moving vehicles.

Referring to FIG. 2, a control computer 72 in a control room, is linked to track sensors 56 along side the paths 20 and 22, to monitor the positions of the vehicles 30 and 32, and to control various events occurring in the amusement system 10. The control computer 72 is also linked to the animated FIGS. 60 and to the detectors 62, to control movement of the animated FIGS. 60 and moving targets 64, to detect when a target is hit, and to record a score for the player or vehicle scoring the hit. The control computer 72 is also linked to the vehicle computer 54, either via the buss bar 58, or through wireless techniques. As shown in FIG. 2, multiple first and second vehicles move along spaced apart on the first and second track, so that there is at least one pair of vehicles in each game room 18 at any given time.

In use, riders board the vehicles 30 and 32 at the load/unload platform 24. A safety restraint keeps the riders seated. The vehicles 30 and 32 then move into the first game room or scene 18. Various animated figures move about in the game room 18, with some moving towards the vehicles 30 and 32, to seemingly threaten the riders. The riders shoot at the animated FIGS. 60 or at the fixed and moving targets 61 and 64, using the weapons 50. The light beam emitted from each weapon 50 is preferably modulated, so that the detectors 62 and control computers 72 can identify each weapon 50 and the rider who successfully "hit" any of the targets or figures.

The control computer 72 preferably provides instructions to the vehicle computer 54 which in turn controls the spin motor 42 and vehicle drive motor 49. For example, if, in one or more of the game rooms or scenes 18, the riders in the "first" vehicle 30 outscore the riders in the "second" vehicle 32 by a preset amount (scoring achieved by successfully hitting a target with a light beam from the weapon 50) then the control computer 72 instructs the vehicle computer 54 to change a movement profile of vehicle 2, e.g., causing vehicle 2 to spin, by turning on the spin motor 42, or causing the second vehicle 32 to slow down, by slowing the drive motor 49 or both. The control computer 72 and vehicle computer 54 control all aspects of the amusement system, such as vehicle, animated figure, and target movement and position, sound and lighting effects, simulated gun and scoring characteristics, etc., using well known techniques.

Of course, other aspects of the ride, in addition to vehicle movement, can also be changed based on the occurrence or non-occurrence of an event. The vehicle computer 54 and the control computer 72 communicate with each other in real time. Any device or activity controlled by the vehicle computer 54 or the control computer 72 (e.g., vehicle movement; guns; targets; animation; sound; lighting; special effects, etc.) can be started, stopped, or changed, based on preprogrammed instructions, events occurring during the ride, or both.

Thus, a novel amusement system has been shown and described. Various modifications may of course be made without departing from the spirit and scope of the invention. The invention, therefore, should not be limited, except to the following claims, and their equivalents.

We claim:

1. An amusement ride, comprising:

a first path at least partially within a building;

a first vehicle movable along the first path, the first vehicle including a chassis, a turntable on the chassis, and a first vehicle body on the turntable;

a vehicle spin motor associated with the turntable for spinning the first vehicle body relative to the chassis;

at least one passenger position in the first vehicle;

at least one simulated weapon associated with the at least one passenger position;

a target on the first vehicle or adjacent to the first path and having a detector capable of detecting an emission from the weapon;

a second path adjacent to at least part of the first path, and a second vehicle moveable on the second path;

a simulated weapon associated with the second vehicle;

a vehicle drive motor in each of the first and second vehicles, for simultaneously moving the vehicles along the first and second paths, respectively; and a controller linked at least indirectly to the detector and to the vehicle spin motor for engaging the spin motor when the detector detects an emission from the weapon associated with the second vehicle.

2. The amusement ride of claim 1 wherein the passenger position is a seat.

3. The amusement ride of claim 1 wherein the simulated weapon comprises an infrared emitter.

4. The amusement ride of claim 1 wherein the second vehicle comprises a chassis, a turntable on the chassis, and a vehicle body on the turntable, and a vehicle spin motor for spinning the body relative to the chassis.

5. The amusement ride of claim 1 wherein the second path is spatially separated from the first path.

6. A method of operating an amusement ride comprising the steps of:

automatically moving a first vehicle along a first path;

automatically and simultaneously moving a second vehicle along a second path that extends at least in part adjacent to and physically separate from the first path;

generating a directed emission;

detecting the emission at a target; and changing the movement of the second vehicle bv spinning the second vehicle upon detection on an emission at the target.

7. The method of claim 6 further comprising the step of generating the directed emission via a passenger in the first vehicle holding a simulated weapon.

8. The method of claim 7 further comprising the step of having the passenger control the timing of an emission from the weapon and the direction of the emission.

9. The method of claim 6 wherein the target is on the second vehicle, and the directed emission is generated by a simulated weapon associated with the first vehicle.

10. The method of claim 6 further comprising the step of generating the directed emission from a location spaced apart from the first and second vehicles, with the directed emission aimed towards the first or second vehicle.

11. An amusement ride, comprising:

a vehicle path within a building;

a vehicle movable along the path, the vehicle including a chassis, a turntable on the chassis, and a vehicle body on the turntable;

a vehicle body motor on the vehicle for turning the vehicle body relative to the chassis;

a plurality of passenger positions in the vehicle body;

an emission generator associated with at least one of the passenger positions and linked to a vehicle computer on the vehicle, the emission generator generating an emission when triggered;

an emission detector on the vehicle or adjacent to the vehicle path connected to the vehicle computer, and capable of detecting an emission from a source off of the vehicle spinning the vehicle upon detection of the emission at the detector; and a ride control computer in communication with the vehicle computer, and with the ride control computer controlling aspects of the ride, based on preprogrammed instructions.

12. An amusement ride comprising:

a first path extending at least in part through a building;

a second path separate from the first path and extending at least in part adjacent to the first path;

at least one controller linked to the first and second vehicles for automatically moving them along the first and second paths, at the same time;

a detector for detecting an action by a passenger in the first vehicle; and a spin motor linked to the detector, for spinning the second vehicle when the detector detects the action by the passenger in the first vehicle.

13. An amusement ride comprising:

first and second spatially separated paths extending through a plurality of rooms within a building;

first and second vehicles movable at the same time along the first and second paths, respectively;

a vehicle computer on each vehicle;

a ride control computer in communication with each vehicle computer, and with the ride control computer controlling aspects of a ride, based on preprogrammed instructions;

an emission generator for generating a directed emission based on an action by a passenger in the first vehicle;

a detector on the second vehicle or adjacent to the second path for detecting the emission from the emission generator; and a vehicle turning actuator linked to the detector, for turning the second vehicle when the detector detects an emission at the target.

14. The amusement ride of claim 13 wherein each vehicle includes a chassis, a turntable on the chassis, and a vehicle body on the turntable.

15. The amusement ride of claim 14 further comprising a vehicle body motor on each vehicle for turning the vehicle body relative to the chassis.

16. The amusement ride of claim 15 wherein the second vehicle body is turned by energizing the vehicle body motor on the second vehicle when the detector detects the emission at the target.

17. An amusement ride, comprising:

a first path at least partially within a building;

a first vehicle movable along the first path, the first vehicle including a chassis, a turntable on the chassis, and a vehicle body on the turntable;

a second path physically separated from the first path, and a second vehicle moveable along the second path;

a vehicle computer on each vehicle;

a ride control computer in communication with each vehicle computer, and with the ride control computer controlling aspects of a ride, based on preprogrammed instructions;

vehicle drive means for simultaneously moving the first vehicle and the second vehicle along the first and second paths, respectively;

detecting means for detecting an action by a passenger in the second vehicle; and spinning means, linked to the detecting means, for spinning the first vehicle body relative to the chassis when the detecting means detects the action by a passenger in the second vehicle.

* * * * *